US006612944B1

(12) United States Patent
Bureau

(10) Patent No.: US 6,612,944 B1
(45) Date of Patent: Sep. 2, 2003

(54) PROTECTIVE COVERING FOR A HOCKEY STICK BLADE

(76) Inventor: Timothy L. Bureau, 8525 Oak Pointe Way, Fairfax Station, VA (US) 22039

( * ) Notice: Subject to any disclaimer, the term of this patent is extended or adjusted under 35 U.S.C. 154(b) by 0 days.

(21) Appl. No.: 09/678,343

(22) Filed: Oct. 3, 2000

(51) Int. Cl.[7] ..... A63B 59/14
(52) U.S. Cl. ..... 473/563; 206/315.1
(58) Field of Search ..... 473/560–563; 206/315.1

(56) References Cited

U.S. PATENT DOCUMENTS

| | | | | |
|---|---|---|---|---|
| 2,912,245 A | | 11/1959 | Gardner et al. | |
| 3,353,826 A | | 11/1967 | Traverse | |
| 3,377,065 A | | 4/1968 | White, Sr. | |
| 3,458,194 A | | 7/1969 | Coles | |
| 4,651,990 A | | 3/1987 | Profit | |
| 5,127,649 A | * | 7/1992 | Carbonero | 473/563 |
| 5,294,113 A | | 3/1994 | Ladouceur et al. | |
| 5,558,326 A | | 9/1996 | Adamson et al. | |
| 5,752,698 A | | 5/1998 | Desroches | |
| 5,758,767 A | * | 6/1998 | Hincher | 206/315.1 |
| 5,816,962 A | * | 10/1998 | Etersque | 473/563 |

FOREIGN PATENT DOCUMENTS

| | | |
|---|---|---|
| GB | 547946 | 9/1942 |

* cited by examiner

*Primary Examiner*—Mark S. Graham
(74) *Attorney, Agent, or Firm*—Nixon & Vanderhye

(57) ABSTRACT

A cover is provided for the blade and shank portion of a hockey stick. The cover includes an elongated sleeve and an extension and has an opening along a rear edge thereof for receiving the blade and shank portion. The extension and sleeve lie at an angle relative to one another corresponding to the angle between the shank portion and the blade of the hockey stick. One or more fasteners are provided about the opening for securing the cover to the hockey stick. A notch is provided between the upper edge of the sleeve and the forward edge of the extension to accommodate variances in the arcuate surfaces of sticks between the blades and shank portions and to ventilate the blade after use.

12 Claims, 9 Drawing Sheets

PROTECTIVE COVERING FOR A HOCKEY STICK BLADE

TECHNICAL FIELD

The present invention relates to a protective cover for the blade of an ice hockey stick and particularly to a cover for protecting the blade and surfaces which come into contact with the sticky black friction tape normally applied to the blade.

BACKGROUND

Ice hockey sticks generally comprise a blade, a shaft extending at an angle to the length of the blade and a throat area where the shaft and blade form the angle with one another. The angle between the shaft and the blade is known as the "lie" of the stick and generally most hockey sticks, at least in recent times, have similar lies. For decades, hockey sticks have been made of wood or wood laminates. Within the past few years, however, shafts have been made from aluminum or compositions of graphite, Kevlar® and other synthetics. The end of each of these shafts is typically hollow to receive the stem of a wooden blade, either as part of the original hockey stick or as a replacement blade. The wooden blades are attached to the metal or synthetic sticks, typically by using glue, the shaft end being expanded by heat to facilitate reception of the stem within the hollow shaft end. As the shaft cools, it contracts about the stem and the glue hardens, making an extremely durable bond between the shaft and blade. Also, hockey sticks are commercially available in senior or junior sizes. The difference is that the junior size has a slightly shorter shaft length and smaller cross-section.

Apart from normal on-ice use of hockey sticks, they are frequently subjected to substantial use and abuse. For example, younger hockey players typically mistreat their hockey sticks by using the sticks outside of the hockey rink. Typically, the off-ice hockey stick is used to flip or drive not only hockey pucks but rocks and other similar objects, for example, in the streets, parking lots, or during games of "street" hockey. As a result, the wooden hockey blades are often chipped, splintered or frayed along their edges, which degrades their effectiveness on the ice and creates a potential source of problems off-ice, for example, hooked clothing, ripped car seats, splinters and the like. The useful life of such mistreated and abused hockey sticks is therefore considerably shortened, oftentimes resulting in the need to purchase an expensive new hockey stick or at least a replacement blade because of the damage incurred off the ice.

Further, most players typically cover the blades with a sticky black tar-like friction tape to afford better control of the puck while on the ice. The presence of the tar-like friction tape on the blade, however, causes a variety of problems, including black markings left on various surfaces contacted by the black tape. For example, hockey sticks are normally transported by car or van. Contact between the tape on the blades and surfaces in the cargo area or trunk of the vehicle leaves unsightly black markings. Similar markings or stains also appear on floors or walls, causing unsightly appearances, requiring removal and which removal is quite difficult.

One form of protection for a hockey stick currently commercially available is a hockey stick bag. The bag is elongated and shaped generally to conform to the dimensions and shape of the hockey stick. The bag completely encompasses or envelops the entire hockey stick. These bags are essentially bulky, difficult to use and difficult to close. These difficulties have led to non-use of the bags, even when available. Additionally, a number of different coverings for hockey stick blades are disclosed in the patent literature, including U.S. Pat. Nos. 3,377,065; 5,127,649; 4,651,990 and 5,294,113. The coverings of these patents have various drawbacks, including the degree of difficulty of application of the covering to the hockey stick, cost and other factors. Accordingly, there has developed a need for a protective cover for a hockey stick blade which serves the purposes of protecting the blade from damage while also protecting adjacent surfaces from contact with the sticky friction tape normally applied to the blade and, at the same time, is inexpensive and readily and easily manufactured.

DISCLOSURE OF THE INVENTION

In accordance with a preferred embodiment of the present invention, there is provided a cover for the blade of a hockey stick including an elongated sleeve for receiving the blade and an extension of the sleeve for at least partially enveloping a portion of the shank of the hockey stick adjacent the blade. The cover is preferably formed of a flexible material such as a high-abrasion and tear-resistant nylon but may be formed of other types of flexible materials and may also be formed of a semi-rigid plastic material. The sleeve of the cover fully envelops the blade and overlies the black sticky tape on the blade, thus forming a barrier preventing direct contact between the sticky black friction tape and an adjacent surface.

In a preferred embodiment of the present invention, the sleeve has a closed end and an opposite open end, i.e., a closed toe portion and an open heel portion. The extension at the open end of the sleeve angles from the sleeve at substantially the same angle as the shank is angled relative to the hockey stick blade. The extension includes one or more fasteners, for example, hoop and loop (Velcro®) strips, such that the hockey stick blade can be inserted into the open end of the sleeve, with the fastener(s) closing about the rear edge of the extension to retain the sleeve on the stick in overlying protective relation to the blade. In a preferred form, a pull, for example, a loop of flexible material, may be provided on the toe portion of the sleeve to facilitate removal of the sleeve from the blade upon release of the fastener(s).

A notch is preferably provided at the juncture of the sleeve and the extension and along the upper edge of the sleeve. The notch extends laterally from the upper edge of the sleeve and at least in part along opposite sides of the sleeve for a very limited extent. The notch accommodates the angularity between the shank and blade of the stick, thereby eliminating stresses at the juncture of the extension and sleeve. The notch also affords a ventilation port for the blade after use. It will be appreciated that the sleeves being formed of flexible material or a semi-rigid plastic material accommodate curvatures of the blades in either direction, i.e., blades curved oppositely for right or left-handed players. Also, the cover, albeit in a different size and shape, is useful with a goalie's stick, with the same advantageous benefits and results.

In a further preferred form of the present invention, a reinforcement may be formed along the lower edge of the sleeve to provide a degree of rigidity to the edge. Consequently, if the hockey stick with the cover overlying the blade is used off-ice or even on-ice, substantial resistance to wear and abrasion of the sleeve is afforded by the reinforcement. In a still further preferred embodiment, the cover may be formed to provide for either top or bottom entry of the blade and shank portion of the stick into the cover. For top entry, the upper edge of the sleeve, as well as the forward edge of the extension may be open. Once the blade and shank portion are inserted through the openings, fasteners such as zippers or Velcro®-type fasteners, may be closed to close the upper edge of the sleeve over the upper edge of the blade and the forward edge of the extension along the forward edge of the shank portion. For bottom entry, the margins of the cover along the lower edge of the sleeve and rearward edge of the extension may be opened and similar-type fasteners applied to secure the cover to the hockey stick once received within the cover.

In a preferred embodiment according to the present invention, there is provided an article for covering the blade of a hockey stick comprising a cover including an elongated sleeve and an extension of the sleeve, the sleeve being closed at a forward end thereof, the sleeve and the extension forming an opening along a rear margin of the cover for receiving the blade and a shank portion, respectively, of the hockey stick with the blade being receivable within the sleeve and the shank portion being receivable within the extension, the sleeve generally conforming to the shape of the blade and having a length to envelop the blade, the extension extending at an angle to and from the sleeve corresponding generally to an angle between the blade and shank portion of the hockey stick for extending at least in part along the shank portion of the hockey stick upon insertion of the blade into the sleeve and at least one fastener carried by the cover and cooperable therewith to in part close the opening to preclude removal of the blade from the sleeve after the blade has been inserted into the sleeve.

In a further preferred embodiment according to the present invention, there is provided a cover for the blade of a hockey stick comprising an elongated sleeve closed at one end and having an extension extending at an angle to the sleeve corresponding generally to an angle between the blade and a shaft portion of the hockey stick for extending at least in part along the shank portion of the stick when the blade is received in the sleeve, the sleeve and the extension thereof having an opening along one of an upper margin and a lower margin of the cover for receiving the blade within the sleeve and the shank portion within the extension and at least one fastener carried by the cover for closing the opening to retain the blade and shank portion within the sleeve and extension, respectively, thereby affording a protective cover for the blade.

BEST MODE FOR CARRYING OUT THE INVENTION

Figure 1:
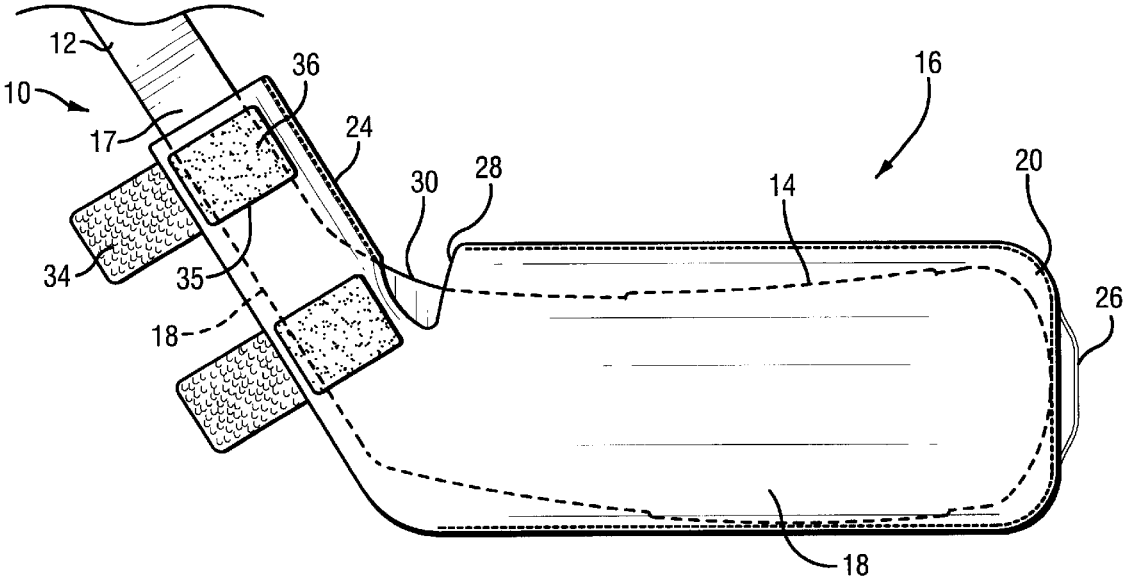
FIG. 1 is a side elevational view of a cover for a hockey stick blade constructed in accordance with a preferred embodiment of the present invention and illustrated with the blade and a shank portion of the hockey stick within the cover with the fasteners in an open position.
Figure 2:
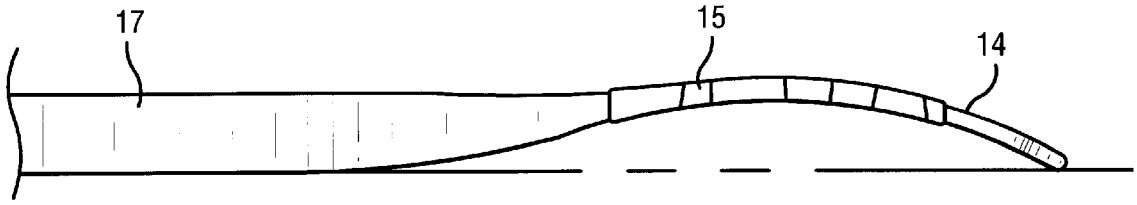
FIG. 2 is a fragmentary top plan view of a hockey stick, blade and shank portion.
Figure 3:
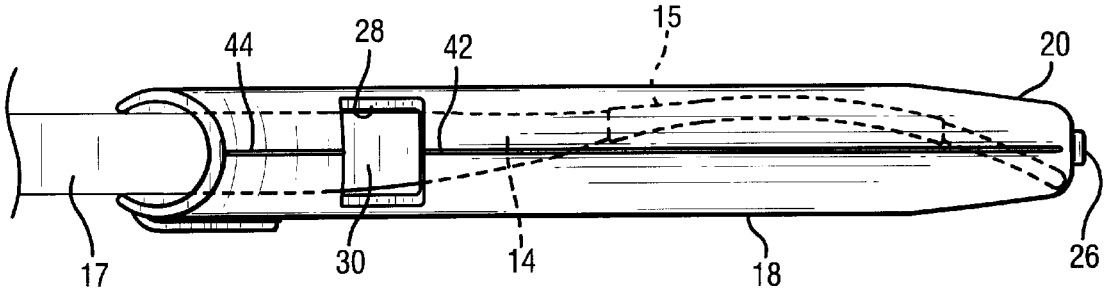
FIG. 3 is a top plan view of the cover of FIG. 1, with the fasteners secured retaining the cover on the blade.

Referring now to the drawings, particularly to FIG. 1, there is illustrated a hockey stick, generally designated 10, having a shank portion 12 and a curved blade 14 extending at an angle relative to the shank portion 12. In FIGS. 2 and 3, sticky black friction tape illustrated at 15 is typically applied to the blade. A cover, generally designated 16, constructed in accordance with a preferred embodiment of the present invention, overlies the taped blade 14 and a portion 17 of the shank 12 of the hockey stick 10. The cover 16 has an opening along a rear edge thereof and includes an elongated sleeve 18 having a closed end or toe portion 20 the opposite end or heel portion 22 (FIG. 4) being open and forming part of the rear opening 19 of the cover 16. Attached to and preferably forming an integral part of the sleeve 18 at the heel or open end 22 is an extension 24. Like sleeve 18, extension 24 is open along its rear edge and forms a part of the rear opening 19 of the cover 16. As illustrated in FIG. 1, the elongated sleeve 18 and extension 24 are angularly related one to the other similarly as the blade 14 and shank portion 12 are angularly related to one another.

The cover is preferably formed of a high-strength, abrasion and tear-resistant material such as nylon. It will be appreciated, however, that other types of fabric materials may be used, such as a canvas. Also, the cover may be formed of a semi-rigid plastic material. Also as illustrated in FIG. 1, a pull 26, for example, a loop of fabric material sewn or otherwise secured, such as by heat sealing, to the external surface at the closed or toe end portion 20 of the sleeve 18 is provided to facilitate removal of the cover from the hockey stick blade, as noted below.

To accommodate the angle between the shank portion 17 and the blade 14, afford ventilation of the blade after use, and to avoid stress at the angle, a notch 28 is formed between the upper edge of the sleeve 18 adjacent its rear end and the forward edge of the extension 24. The curved surface 30 between the blade and shank portion may vary from stick to stick and the notch therefore accommodates this variance. The notch, located at the angle between the blade and shank portion of the stick, extends at least in part along opposite sides of the sleeve and the extension and spaces the rear sleeve end from the forward margin of the extension.

Figure 11:
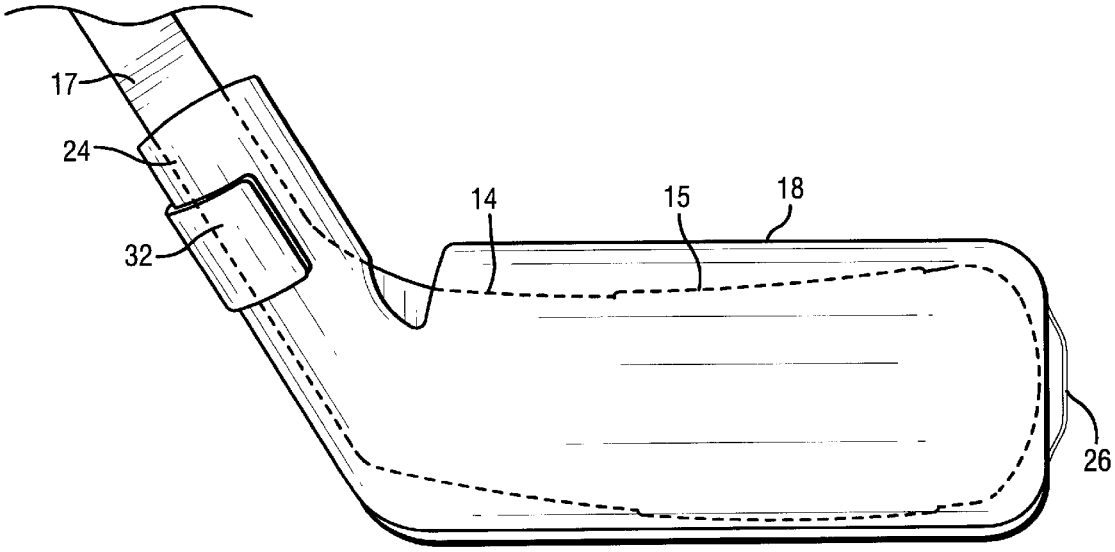
FIG. 11 is a view similar to FIG. 1 illustrating a single fastener about the extension.
Figure 4:
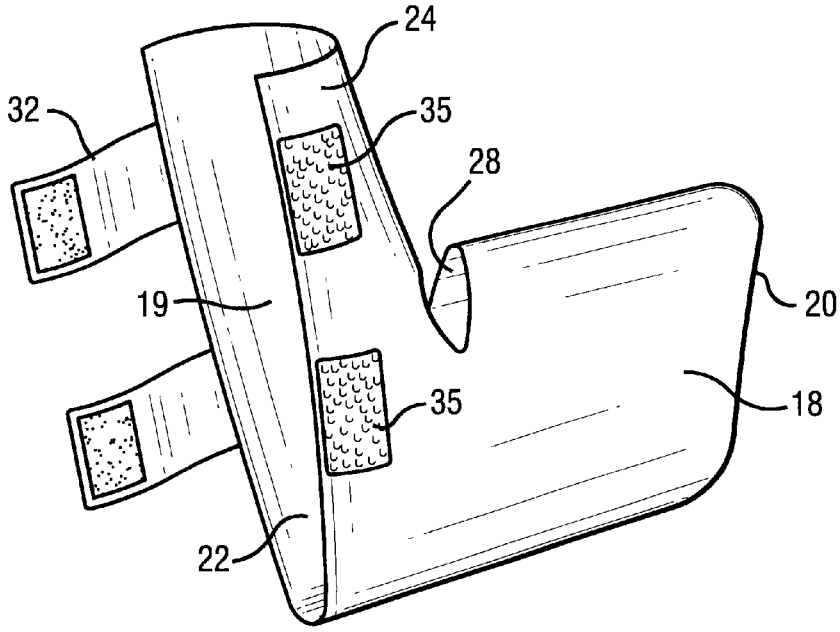
FIGS. 4 and 5 are perspective views, respectively, illustrating the cover hereof and the cover with the blade and shank portion received within the cover.
Figure 5:
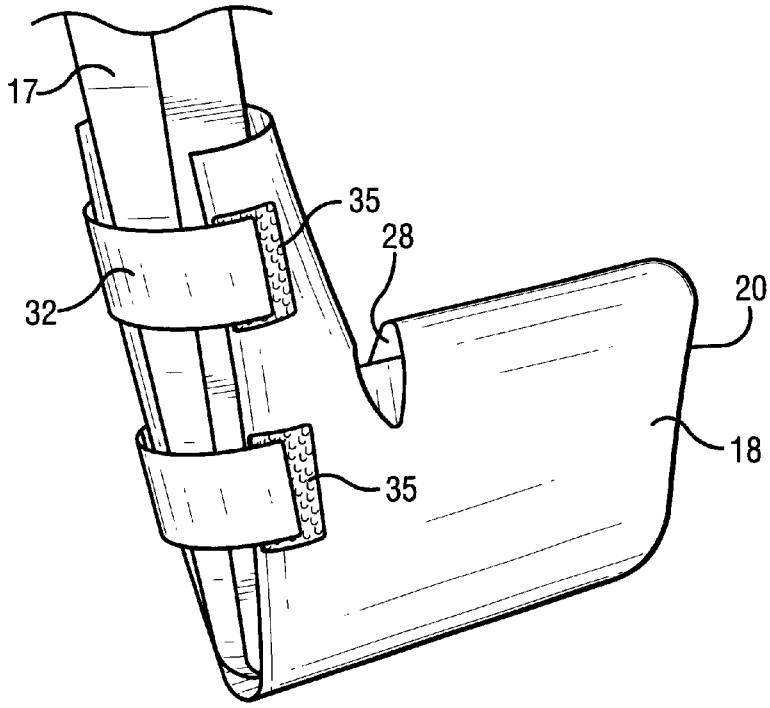

As illustrated in FIGS. 4 and 5, the rear margins of the extension 24 have cooperating fastening elements such that the extension 24 can be closed by the fasteners about the rear edge of the shank portion of the stick when received within the cover. To accomplish this, one or more fasteners includes, for example, a strap 32 extending from one side of extension 24 and having one of hooks and loops 34 (FIG. 1) along its undersurface for cooperation with a patch 35 having another of the hooks or loops 36 secured to another side of the extension 24. The hooks and loops comprise Velcro®-type fasteners. Other types of fasteners may be used such as zippers, buckles, snaps or the like. By closing the one or more straps 32 and engaging the hooks and loops, the rear edge of the shank portion of the stick is engaged by the fastener, retaining the cover on the hockey stick. FIG. 11 illustrates a variant of the cover 16 of FIG. 1 wherein only a single fastener 32 is employed to secure the cover 16 to the blade 14. FIG. 1, of course, illustrates two such fasteners. Preferably, the fastener is tightened about the shank portion 17 such that the notch forming portion adjacent extension 24 contacts the arcuate surface of the hockey stick between the blade 14 and shank portion 17. That is, as illustrated in FIG. 1, the margin of the notch 28 adjacent the extension engages the arcuate surface of the stick while the portion of the notch at the rear edge of sleeve 18 is spaced from the stick and at an elevation higher than the portion of the extension engaging the arcuate stick surface.

Figure 12:
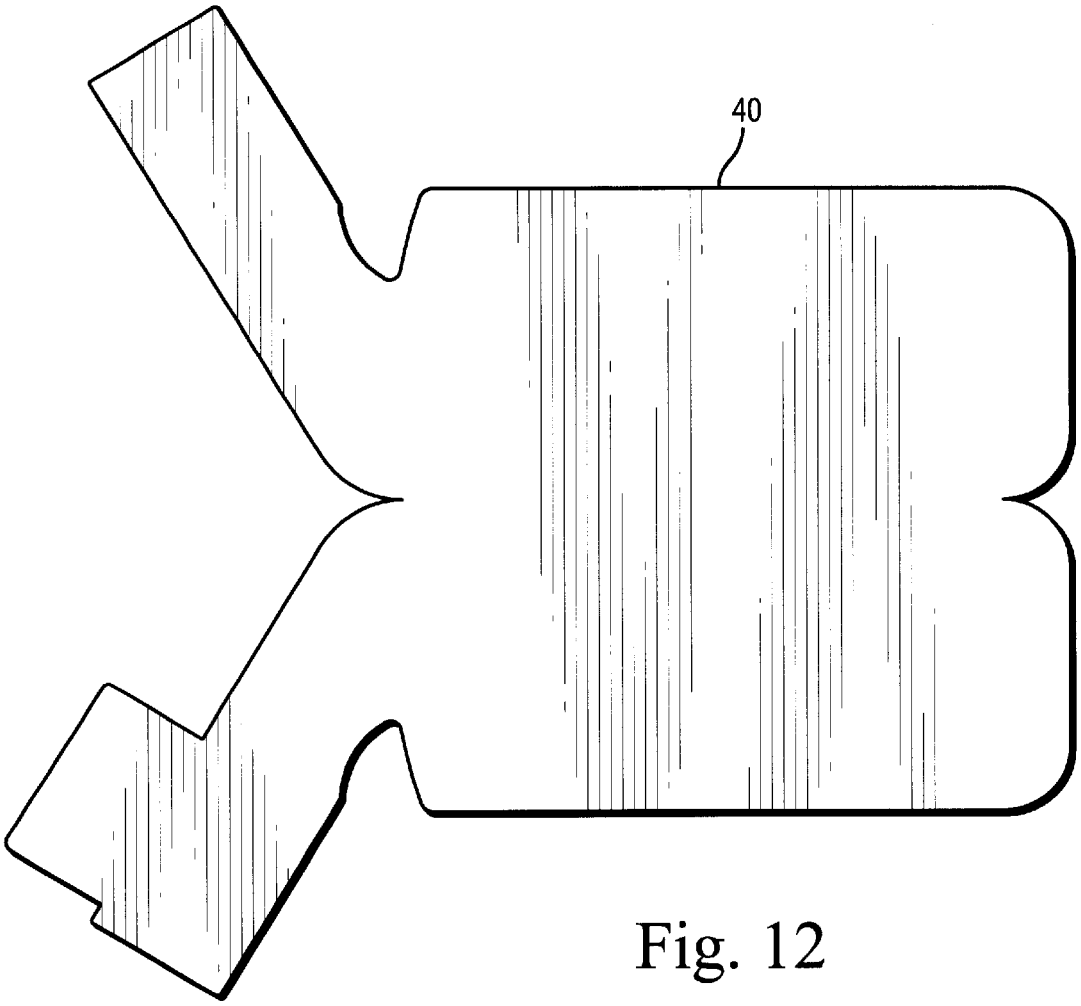
FIG. 12 is a plan view of a single piece of fabric material from which the cover of FIG. 1 may be formed.

Referring now to FIG. 12, it will be appreciated that the cover 16 can be formed of a unitary one-piece fabric material 40. The material 40 may be folded along a midline defining the lower edge of the sleeve and seamed along the opposite and forward margins to form the upper edge and toe portion, respectively, of the sleeve. A seam 42 is illustrated in FIG. 3 along the upper edge of the sleeve. Additionally, the margins of the material 40 are also seamed to one another along the forward edge of the extension, the seam 44 therefor being illustrated in FIG. 3. The seams 42 and 44 are preferably formed by a sewing operation but, depending upon the type of material, other types of seams, e.g., heat-sealed seams should plastic materials be used, may be used. As a further alternative, the cover may be formed of two discrete pieces, e.g., divided along the mid-line of the material illustrated in FIG. 12, one forming essentially the mirror image of the other, with the exception of the fastener 32. The two pieces are secured to one another, e.g., by stitching along upper and lower edges and the toe portion of the sleeve.

Figure 6:
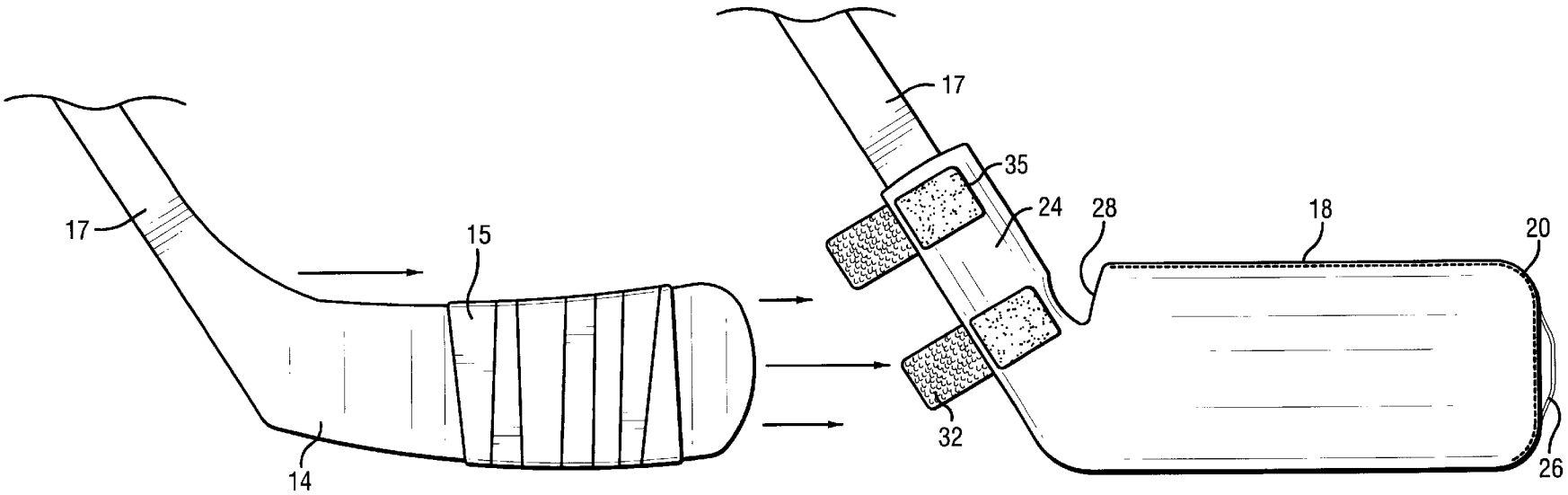
FIG. 6 illustrates the cover of FIG. 1 and a hockey stick blade poised for entry into the rear of the cover.

To apply the cover to the hockey stick and with the fastener(s) open, the rear end of the cover is open to receive the blade 14 as illustrated in FIG. 6. The blade 14 may then be inserted into and through the open end of the cover, with the tip of the blade engaging the interior of the closed toe portion 20 of the cover and the sides of the extension overlying the sides of the shank portion 17. With the blade inserted to its maximum extent, the one or more fasteners may be extended from one side of the extension to the opposite side about the rear edge of the shank portion 17 and secured. It will be appreciated that in this configuration, the tape 21 on the blade portion is fully enveloped by the sleeve 18. Additionally, the cover cannot be removed from the hockey stick absent release of the fasteners.

Figure 7:
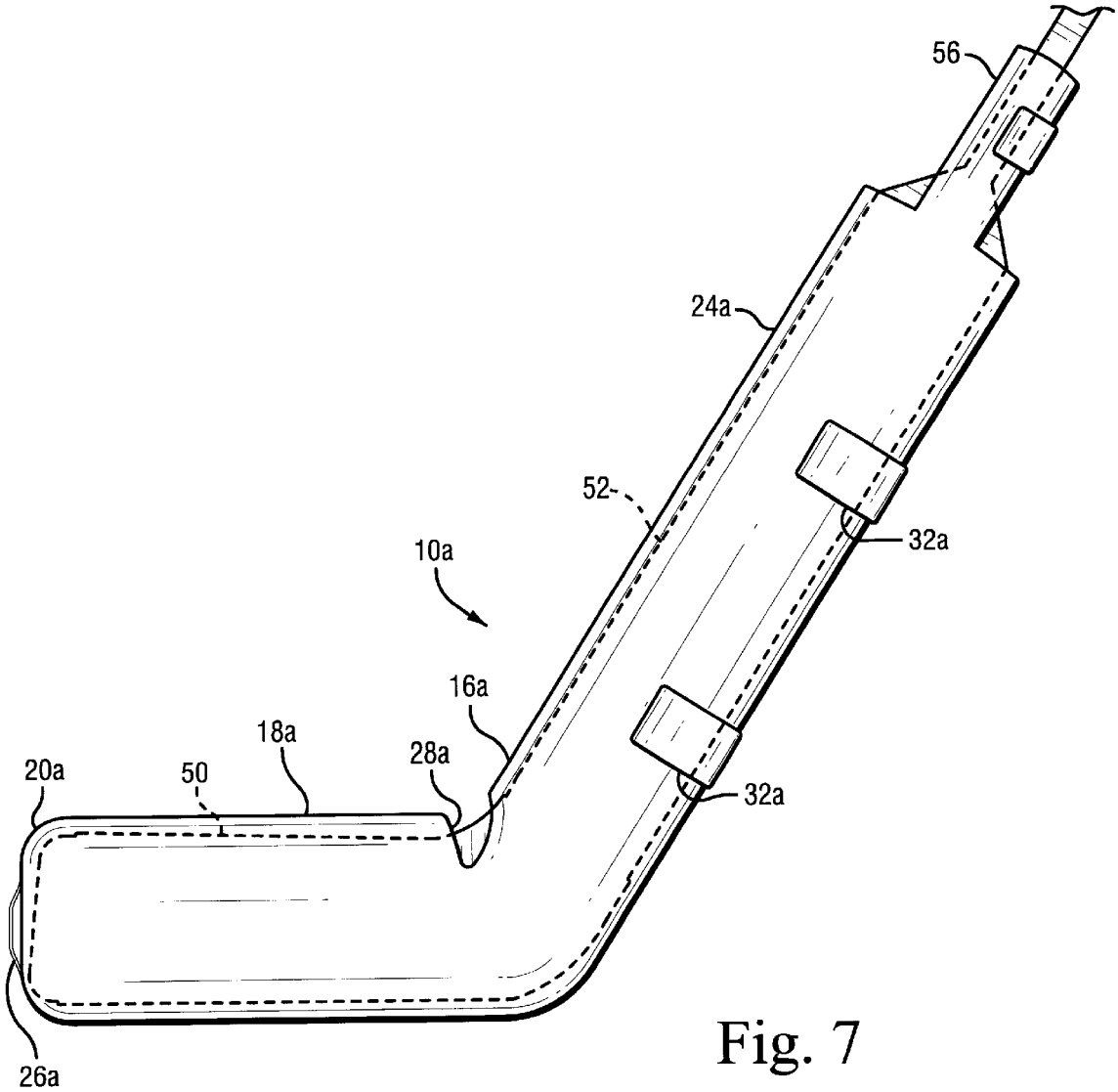
FIG. 7 is a side elevational view of a cover similar to the cover of FIG. 1 and for use with a goalie's hockey stick.
Figure 8:
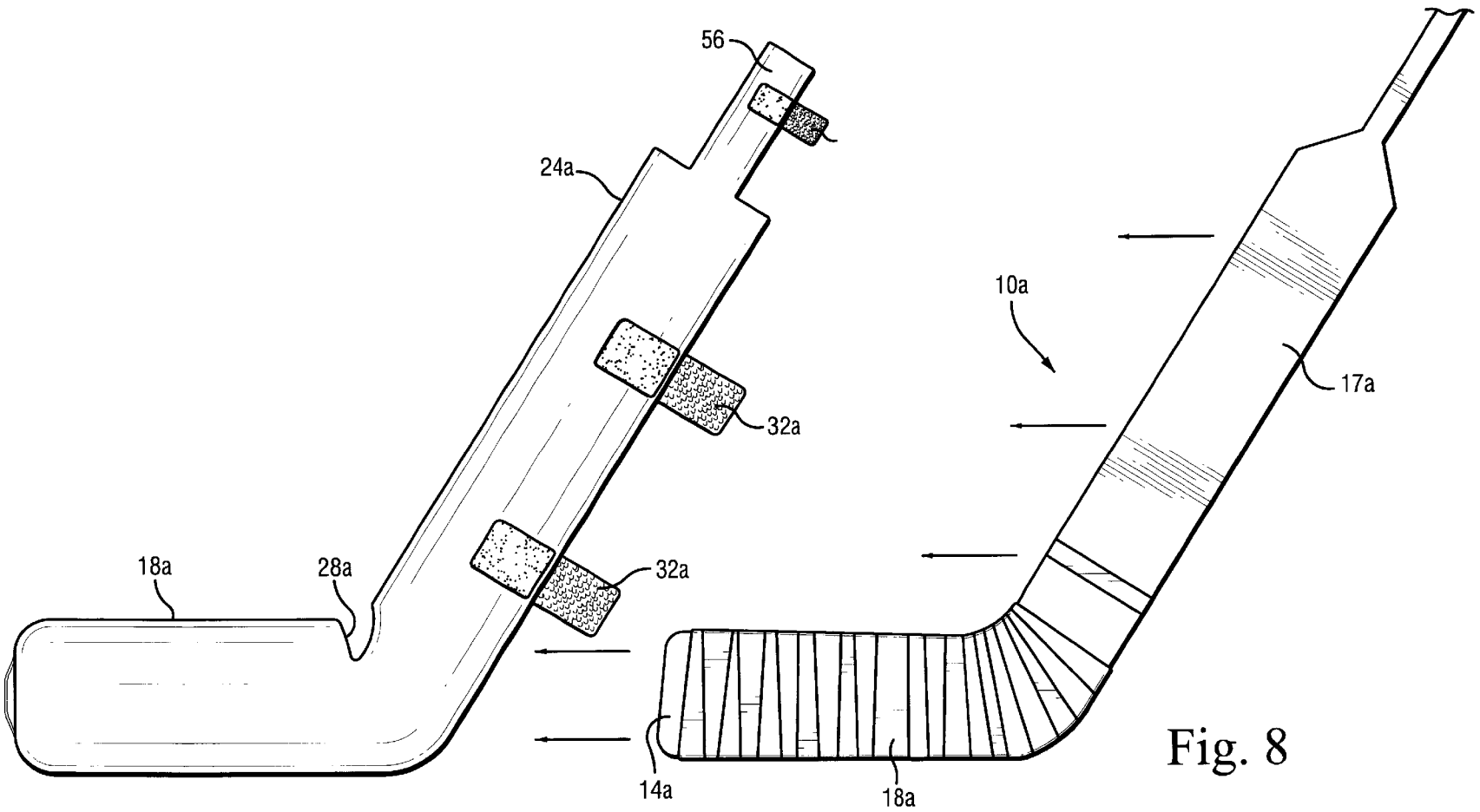
FIG. 8 is a view similar to FIG. 6 illustrating goalie hockey stick blade and shank portion poised for entry into the rear of the cover.

Referring now to FIGS. 7 and 8, wherein like reference numerals are applied to like parts as in the prior embodiment followed by the suffix "a," there is illustrated a goalie stick having a blade 50 and an enlarged shank portion 52. The sleeve 18*a* and extension 24a are formed similarly as in the prior embodiment. However, the extension 24*a* is extended and, of course, enlarged to accommodate the enlarged shank portion 52 of the goalie stick. A further reduced portion of the extension 24*a* is illustrated at 56. Both the extension and reduced portion 56, as well as the sleeve 18*a*, are open along the rear edges thereof, similarly as sleeve 18 and extension 24, such that the goalie stick can be inserted into the cover from the rear of the sleeve. The extension also carries one or more fasteners 32*a* which may be similar to those previously described. As illustrated in FIG. 8, the goalie stick 10*a* is inserted through the rear open edges of the extension 24*a* and sleeve 18*a* until the forward end of the blade and forward edge of the shank portion 52 abut the toe portion 20*a* and forward edge of the extension, respectively. The strap or straps are then fastened, retaining the cover 16*a* on the goalie stick.

Figure 9:
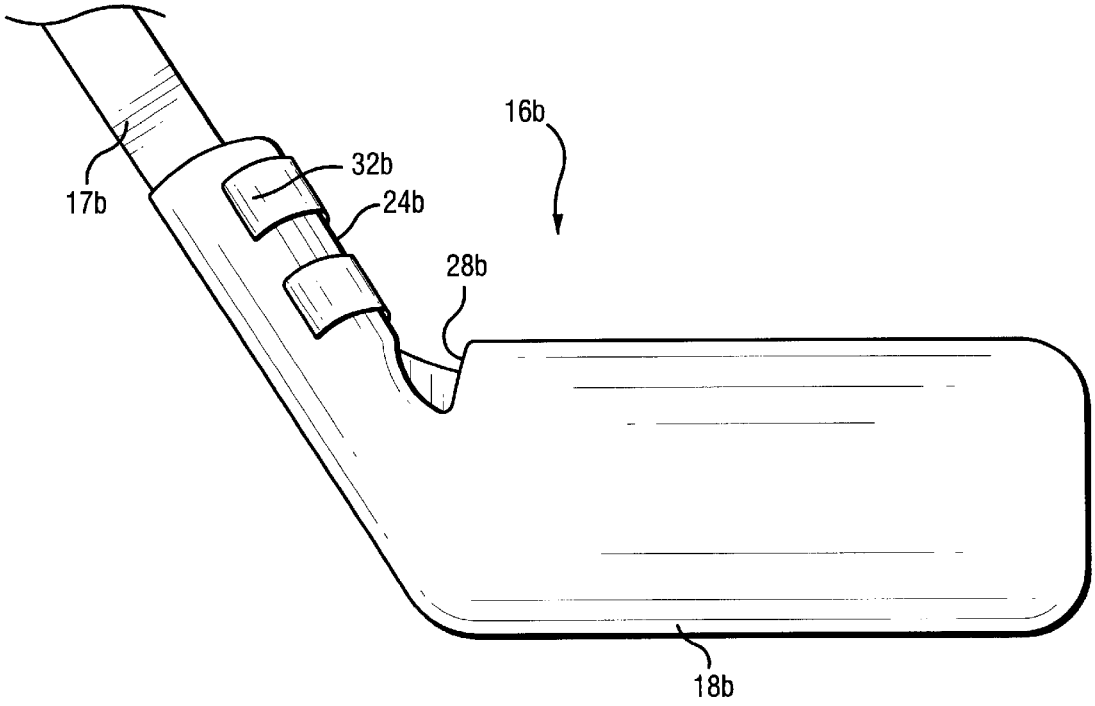
FIG. 9 illustrates a further form of cover where the extension is open along its forward edge.

Referring now to the embodiment of FIG. 9, wherein like reference numerals are applied to like parts as in prior embodiments followed by the suffix "b," the cover 16*b* is similar to the cover 16 of FIG. 1, except that the extension 24*b* is open along its forward edge. One or more fasteners 32*b*, for example, of the Velcro® type, extend from one margin of the extension to overlie the forward edge of the shank portion 17*b*. The fastener(s) is secured to the opposite margin. In this form, the blade may be inserted into the sleeve 18*b* with the shank portion 17*b* being inserted through the opposing forward margins of the extension 24*b*. Once inserted, the fasteners 32 are applied, retaining the cover 16*b* on the hockey stick.

Figure 10:
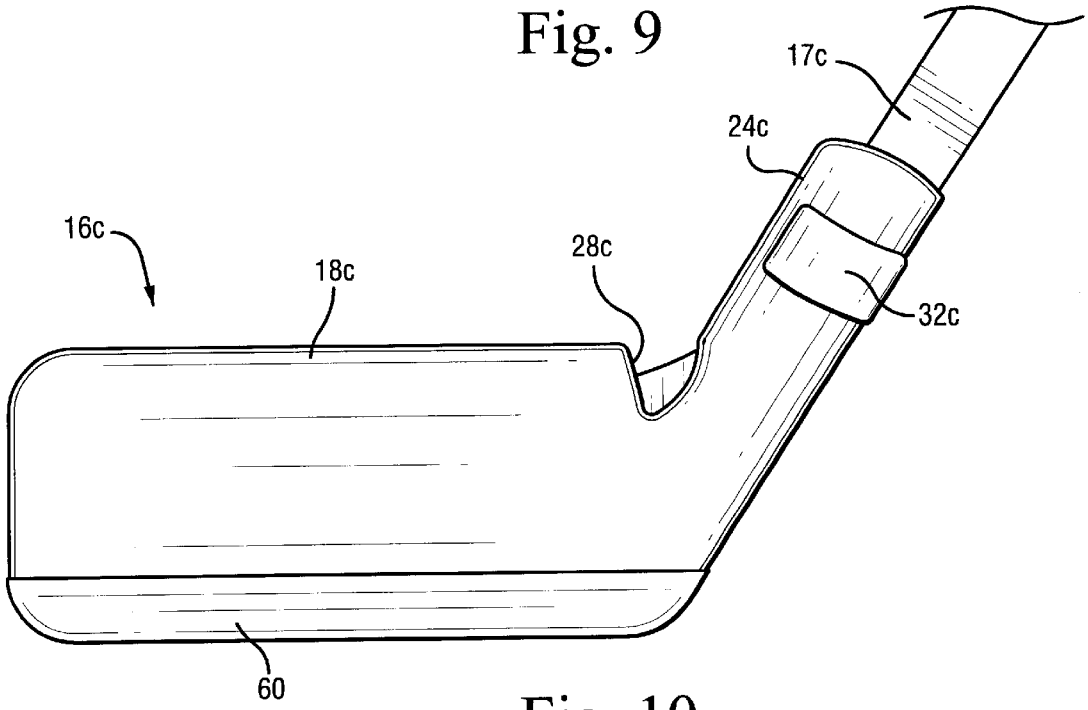
FIG. 10 is a side elevational view of a further embodiment illustrating a reinforcement along a lower edge of the sleeve.

Referring now to the embodiment illustrated in FIG. 10, wherein like reference numerals apply to like parts as in prior embodiments followed by the suffix "c," the cover 16*c* includes a reinforcement 60 along its lower edge. The reinforcement 60 is preferably formed of a semi-rigid material, such as rubber. The reinforcement 60 may, however, be formed of different high-abrasion and tear-resistant materials such as plastic or a heavy-duty fabric overlay. It will be appreciated that the reinforcement 60 reduces the wear and tear on the cover per se should an individual use the stick with the cover attached.

Figure 13:
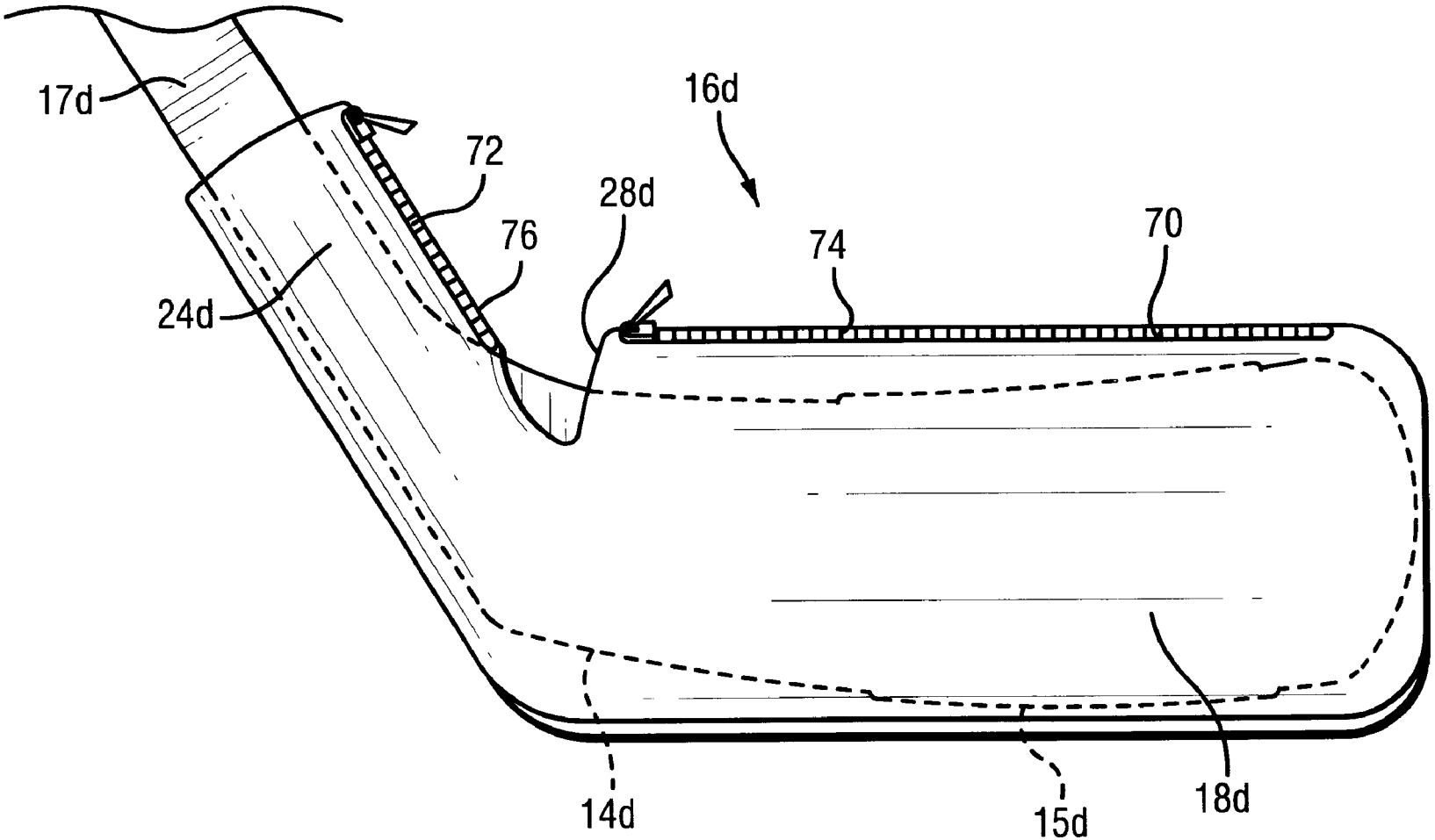
FIG. 13 is a side elevational view of a still further preferred embodiment of the present invention.

Referring now to FIG. 13, wherein like reference numerals are applied to like parts as in prior embodiments followed by the suffix "d," the cover 16*d* is formed to provide for top entry of the blade 14*d* and shank portion 17*d* into the cover. To accomplish this, the upper edge 70 of the sleeve 18*d*, as well as the forward edge 72 of the extension 24*d* are open. Fasteners, such as zippers 74 and 76 are provided to releasably close these edges, as desired. It will be appreciated that the notch 28*d* may be omitted in this form of the invention and a single opening be provided along the upper edge of both the sleeve 18*d* and extension 24*d*. In that form, a single fastener, such as a zipper, may extend the full length of the upper edge of the cover.

It will be appreciated from the foregoing that the cover is readily and easily applied to the hockey stick and in a manner such that the elongated sleeve of the cover completely overlies, envelops and encompasses the blade of the hockey stick. Consequently, a barrier of cover material is provided between the tape on the blade and any surface in which the blade might contact, thereby eliminating scuffing or black marks on any adjacent surfaces contacted by the tape. Additionally, the notch accommodates variously shaped arcuate surfaces between the blades and shank portions of the various sticks, affords ventilation of the blade after use and avoids stresses on the cover which might otherwise tear the cover. Also, the cover is formed of a relatively inexpensive, yet sturdy fabric or semi-rigid plastic.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An article for covering the elongated blade and a portion of the shank of a hockey stick comprising:

a cover including an elongated sleeve and an extension of said sleeve forming a predetermined substantially fixed angle with said sleeve prior to receiving the blade and the shank portion within the cover, said sleeve being closed at a forward end thereof, said cover forming an opening along a rear margin thereof enabling the sleeve and extension to receive the blade and the shank portion, respectively, of the hockey stick;

said cover generally conforming to the shape of the blade and shank portion, said sleeve and said extension having a combined length to envelop the blade and shank portion, respectively;

said extension extending at an angle to and from said sleeve corresponding generally to an angle between the blade and shank portion of the hockey stick whereby the extension extends at least in part along the shank portion of the hockey stick upon insertion of the blade into the sleeve;

at least one fastener carried by said cover and cooperable therewith to at least in part close said opening to preclude removal of the blade from the sleeve after the blade has been inserted into the sleeve; and said cover including a notch formed along an upper edge thereof and adjacent an angle between an upper edge of the blade and the shank portion, said notch extending from said upper edge of the cover at least in part along opposite sides thereof for exposing portions of the hockey stick through said notch when the blade and shank portions thereof are disposed in said cover.

2. An article according to claim 1 wherein said cover is formed of a fabric material, a forward edge portion of the extension and a rearward edge portion of said sleeve in part defining said notch, margins of said notch extending along opposite sides of the cover for exposing portions of the hockey stick through said notch when the blade and shank portions are disposed in said cover.

3. An article according to claim 2 wherein said fastener extends between opposite sides of the cover in a position to overlie a rear edge of the shank portion of the stick to preclude removal of the blade from the sleeve through said opening.

4. An article for covering the elongated blade and a portion of the shank of a hockey stick comprising:

a cover including an elongated sleeve and an extension of said sleeve forming a predetermined substantially fixed angle with said sleeve prior to receiving the blade and the shank portion within the cover, said sleeve being closed at a forward end thereof, said cover forming an opening along a rear margin thereof enabling the sleeve and extension to receive the blade and the shank portion, respectively, of the hockey stick;

said cover generally conforming to the shape of the blade and shank portion, said sleeve and said extension having a combined length to envelop the blade and shank portion, respectively;

said extension extending at an angle to and from said sleeve corresponding generally to an angle between the blade and shank portion of the hockey stick whereby the extension extends at least in part along the shank portion of the hockey stick upon insertion of the blade into the sleeve;

at least one fastener carried by said cover and cooperable therewith to at least in part close said opening to preclude removal of the blade from the sleeve after the blade has been inserted into the sleeve; and a reinforcement along a lower edge of said sleeve extending substantially the entire length thereof.

5. An article according to claim 4 wherein said reinforcement comprises at least a semi-rigid material extending along said lower edge.

6. A cover for the blade of a hockey stick comprising:

an elongated sleeve closed at one end and having an extension extending at a predetermined substantially fixed angle to said sleeve corresponding generally to an angle between the blade and the shank portion of the hockey stick for extending at least in part along the shank portion of the stick when the blade and shank portion are received in the sleeve and extension, respectively;

said sleeve and said extension thereof having an opening along one of an upper margin and a lower margin of said cover for receiving the blade within the sleeve and the shank portion within the extension;

at least one fastener carried by said cover for at least in part closing said opening to retain the blade and shank portion within the sleeve and extension, respectively, thereby affording a protective cover for the blade; and a notch formed along upper margins of said sleeve and said extension adjacent said fixed angle and extending from said upper margins at least in part along opposite sides of the cover exposing portions of the hockey stick within the cover for ventilation thereof.

7. A cover according to claim 6 wherein said opening is formed along upper margins of said sleeve and said extension.

8. A cover according to claim 6 wherein said sleeve and said extension are formed of a one-piece flexible fabric material.

9. A cover according to claim 6 wherein said sleeve and extension are formed of two pieces of fabric material generally the mirror image of one another and seamed to one another along opposing edges.

10. A cover for the blade of a hockey stick comprising:

an elongated sleeve closed at one end and having an extension extending at a predetermined substantially fixed angle to said sleeve corresponding generally to an angle between the blade and the shank portion of the hockey stick for extending at least in part along the shank portion of the stick when the blade and shank portion are received in the sleeve and extension, respectively;

said sleeve and said extension thereof having an opening along one of an upper margin and a lower margin of said cover for receiving the blade within the sleeve and the shank portion within the extension;

at least one fastener carried by said cover for at least in part closing said opening to retain the blade and shank portion within the sleeve and extension, respectively, thereby affording a protective cover for the blade;

a notch formed along upper margins of said sleeve and said extension adjacent said fixed angle and extending from said upper margins at least in part alone opposite sides of the cover exposing portions of the hockey stick within the cover for ventilation thereof; and said cover being formed of fabric material, said opening along a rear edge of said extension remaining in a partial open condition upon, in part, closing the opening after the blade has been inserted into and secured against removal from the sleeve.

11. A cover for the blade of a hockey stick comprising:

an elongated sleeve closed at one end and having an extension extending at a predetermined substantially fixed angle to said sleeve corresponding generally to an angle between the blade and the shank portion of the hockey stick for extending at least in part along the shank portion of the stick when the blade and shank portion are received in the sleeve and extension, respectively;

said sleeve and said extension thereof having an opening along one of an upper margin and a lower margin of said cover for receiving the blade within the sleeve and the shank portion within the extension;

at least one fastener carried by said cover for at least in part closing said opening to retain the blade and shank portion within the sleeve and extension, respectively, thereby affording a protective cover for the blade;

a notch formed along upper margins of said sleeve and said extension adjacent said fixed angle and extending from said upper margins at least in part along opposite sides of the cover exposing portions of the hockey stick within the cover for ventilation thereof; and said cover being formed of a fabric material, opposite sides of the sleeve being spaced from one another a distance sufficient to accommodate a blade of the hockey stick curved out of a plane passing through the hockey stick.

12. A cover for the blade of a hockey stick comprising:

an elongated sleeve closed at one end and having an extension extending at a predetermined substantially fixed angle to said sleeve corresponding generally to an angle between the blade and the shank portion of the hockey stick for extending at least in part along the shank portion of the stick when the blade and shank portion are received in the sleeve and extension, respectively;

said sleeve and said extension thereof having an opening along one of an upper margin and a lower margin of said cover for receiving the blade within the sleeve and the shank portion within the extension;

at least one fastener carried by said cover for at least in part closing said opening to retain the blade and shank portion within the sleeve and extension, respectively, thereby affording a protective cover for the blade;

a notch formed along upper margins of said sleeve and said extension adjacent said fixed angle and extending from said upper margins at least in part along opposite it sides of the cover exposing portions of the hockey stick within the cover for ventilation thereof; and said cover being formed of a fabric material, opposite sides of the sleeve being spaced from one another to accommodate a blade of the hockey stick curved out of a plane passing through the hockey stick without substantial flexing of the fabric of the sleeve.

* * * * *